US011032635B2

(12) United States Patent
Zhang

(10) Patent No.: US 11,032,635 B2
(45) Date of Patent: Jun. 8, 2021

(54) SPEAKER

(71) Applicant: AAC Technologies Pte. Ltd., Singapore (SG)

(72) Inventor: Tong Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/699,151

(22) Filed: Nov. 29, 2019

(65) Prior Publication Data

US 2020/0196048 A1 Jun. 18, 2020

(30) Foreign Application Priority Data

Dec. 17, 2018 (CN) ..... 201822113919.8

(51) Int. Cl.
*H04R 1/28* (2006.01)
*H04R 9/06* (2006.01)

(52) U.S. Cl.
CPC ..... *H04R 1/2811* (2013.01); *H04R 9/06* (2013.01)

(58) Field of Classification Search
None
See application file for complete search history.

(56) References Cited

U.S. PATENT DOCUMENTS 4,709,392 A * 11/1987 Kato ..... H04R 7/26 181/157
2014/0119578 A1* 5/2014 Choi ..... H04R 1/00 381/162
2015/0016657 A1* 1/2015 Song ..... H04R 7/10 381/398
2016/0014519 A1* 1/2016 Oclee-Brown ..... H04R 7/02 381/398
2016/0227324 A1* 8/2016 Cai ..... H04R 7/14
2017/0347197 A1* 11/2017 Mao ..... H04R 9/025
2017/0347200 A1* 11/2017 Mao ..... H04R 9/06
2018/0027334 A1* 1/2018 Mao ..... H04R 7/18 381/398
2018/0027336 A1* 1/2018 Li ..... H04R 9/06 381/398
2019/0028804 A1* 1/2019 Zhao ..... H04R 9/02

* cited by examiner

*Primary Examiner* — Paul W Huber
(74) *Attorney, Agent, or Firm* — W&G Law Group LLP

(57) ABSTRACT

The present invention provides a speaker, which includes a basket, a diaphragm fixed to the basket, and a voice coil located below the diaphragm and used for driving the diaphragm to vibrate and sound. The diaphragm includes a dome and a folded ring, and the dome includes first side edges arranged oppositely and second side edges connected with the first side edges and arranged oppositely. The dome includes two or more opening portions disposed separately along the first side edge or the second side edge, and an extended portion is arranged between two adjacent opening portions.

6 Claims, 3 Drawing Sheets

SPEAKER

TECHNICAL FIELD

The present disclosure relates to electroacoustic technologies, and more particularly, to a speaker.

BACKGROUND

An electroacoustic device is a member in an electronic field. With a development of an electronic industry, an electroacoustic system needs to continuously meet a higher requirement of consumers for product performance and to present essence of sounds more perfectly.

As a core sound member of a speaker, quality for designing a diaphragm directly affects acoustic performance of the speaker. The diaphragm usually includes a dome in a center and a folded ring surrounding the dome. The vibration of the diaphragm is mainly focused on the vibration of the dome. The dome has a larger amplitude and a higher frequency than that of the folded ring, and is an important part for reflecting an acoustic effect of a sound device.

The dome in existing technologies is a plate structure, and is a rectangle with rounded corners. In order to reduce mass of the dome, holes are usually cut in a middle portion of a straight edge of the dome. Because the middle portion of the dome is prone to split vibration due to insufficient strength when the dome is vibrating at a high frequency, cutting holes in the middle portion of the straight edge of the dome is bound to severely reduce a strength of the dome and affect high-frequency characteristic of the product. Especially for a product with a large aspect ratio, if a size of the hole cut in the middle portion of the straight edge of the dome is too large, the strength of the middle portion of the dome will be seriously affected; if the size of the hole is too small, the mass of the dome cannot be well reduced preferably.

Therefore, it is necessary to provide a new speaker with an improved dome structure.

DETAILED DESCRIPTION

Figure 1:
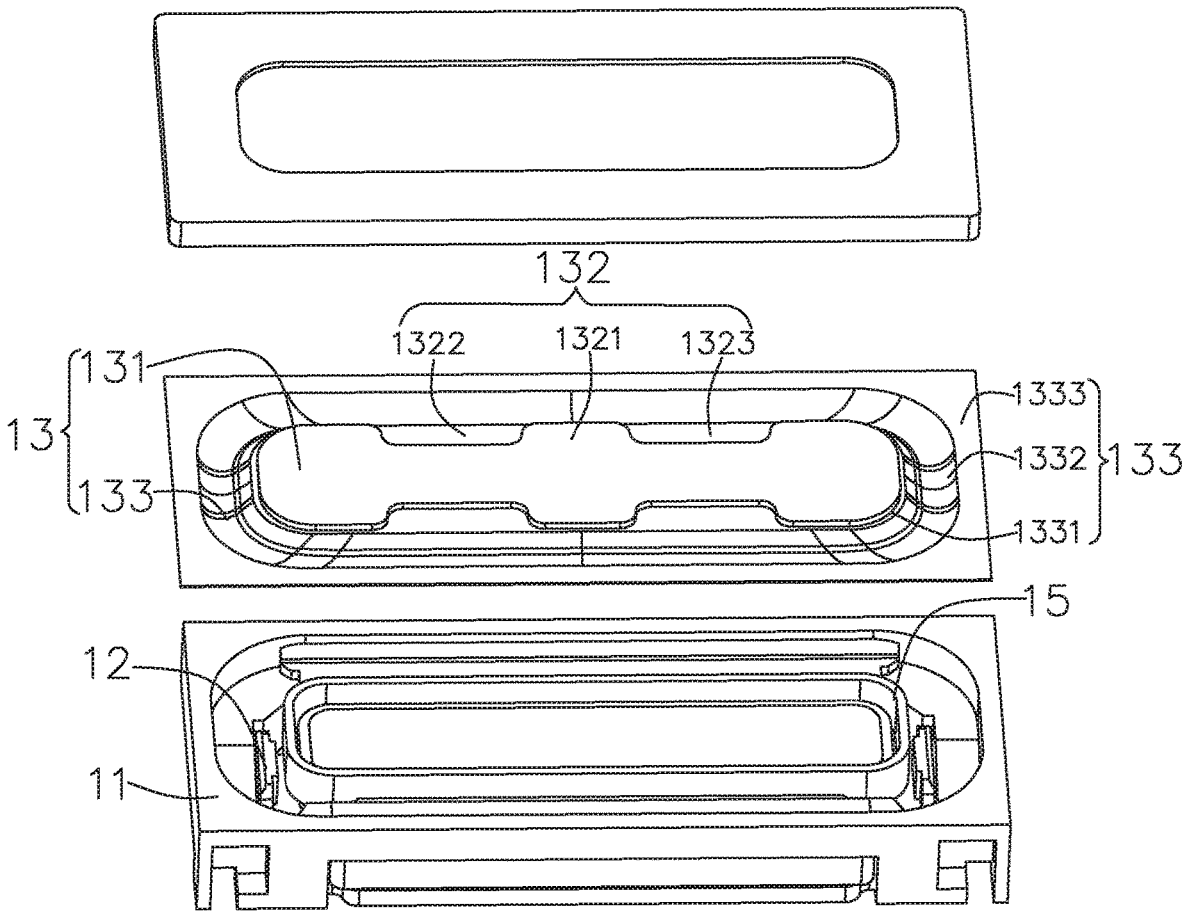
FIG. 1 is an exploded perspective view of a speaker according to the present disclosure.

In order to better understand solutions of the present disclosure and advantages thereof in various aspects, the present disclosure will be described in further detail below with reference to drawings through specific embodiments. In the following embodiments, a left-right direction in a principal plane of the drawing is taken as a horizontal direction, and an up-down direction in the principal plane of the drawing is taken as a vertical direction. In addition, the following specific embodiments are provided to facilitate a clearer and more thorough understanding of contents of the present disclosure, rather than to limit the present disclosure.

For a product with a large aspect ratio, in order to effectively reduce mass of the dome while ensuring that high-frequency characteristic of the product is not affected, the present disclosure improves a structure of a dome, and the specific solution is as follows.

Figure 2:
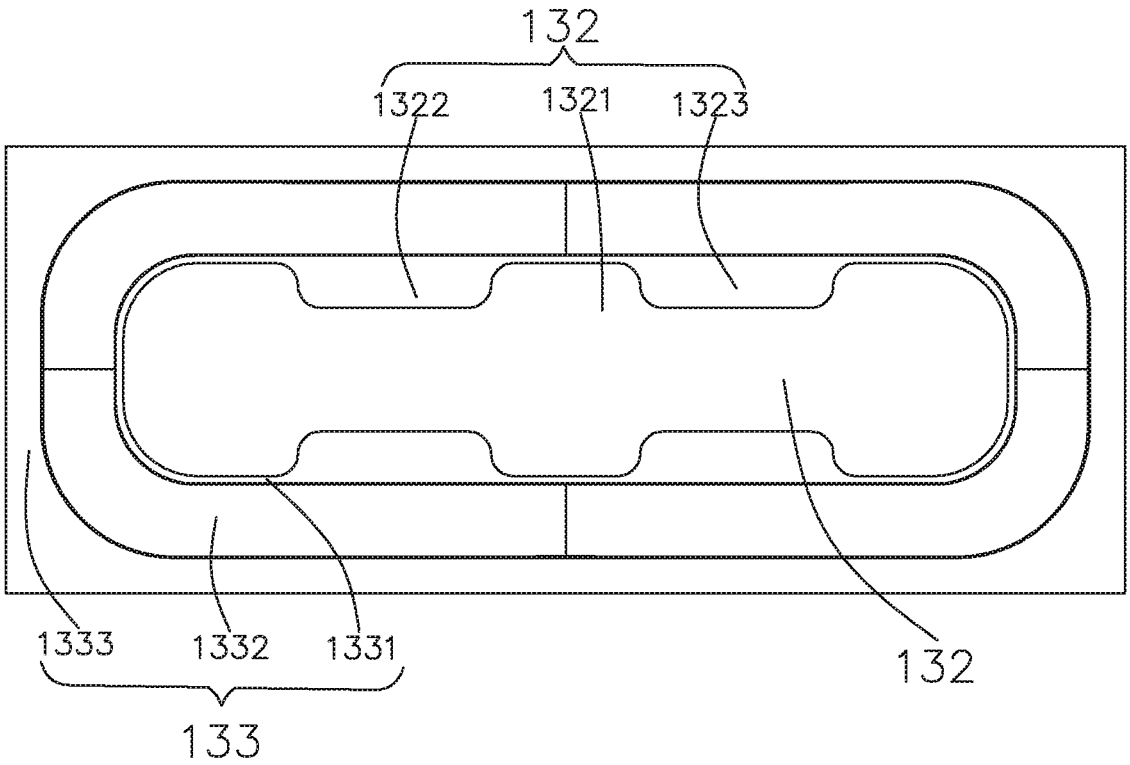
FIG. 2 is a partial structure view of a diaphragm in the speaker according to the present disclosure.

As shown in FIG. 1 and FIG. 2, the present disclosure provides a speaker having a dome with a new structure. The speaker includes a basket 11, a diaphragm 13 fixed to the basket 11, a voice coil 15 located below the diaphragm 13 and used for driving the diaphragm 13 to vibrate and sound, and a magnetic circuit system 12 located below the diaphragm 13 and fixed to the basket 11. The diaphragm includes a dome 131 in a central region and a folded ring 133 surrounding the dome 131.

Figure 3:
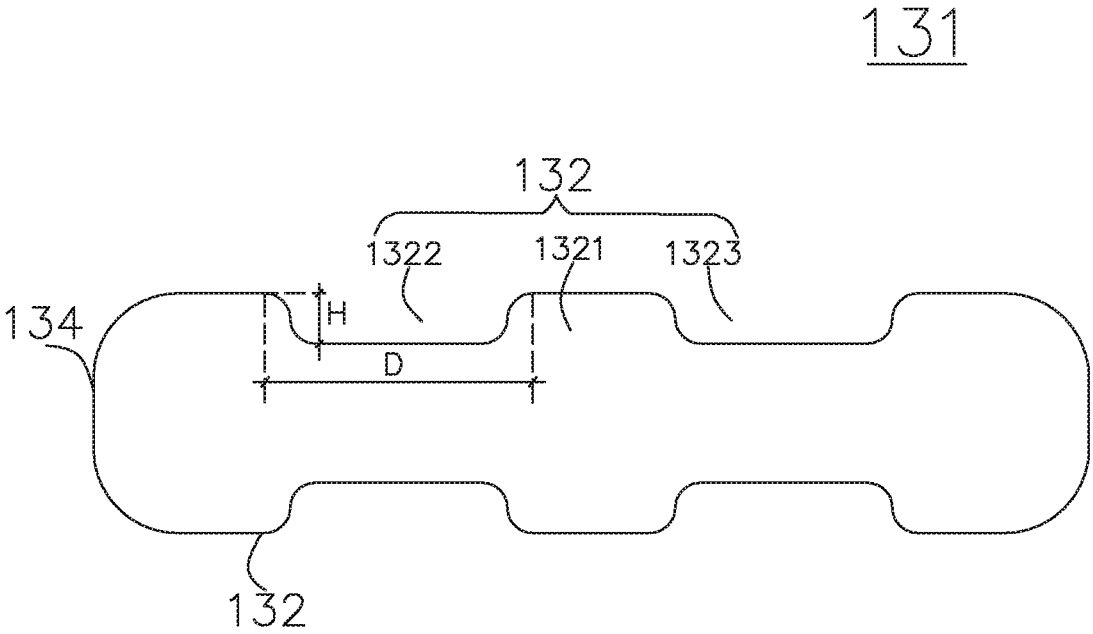
FIG. 3 is a plan view of a dome in the speaker according to the present disclosure.
Figure 4:
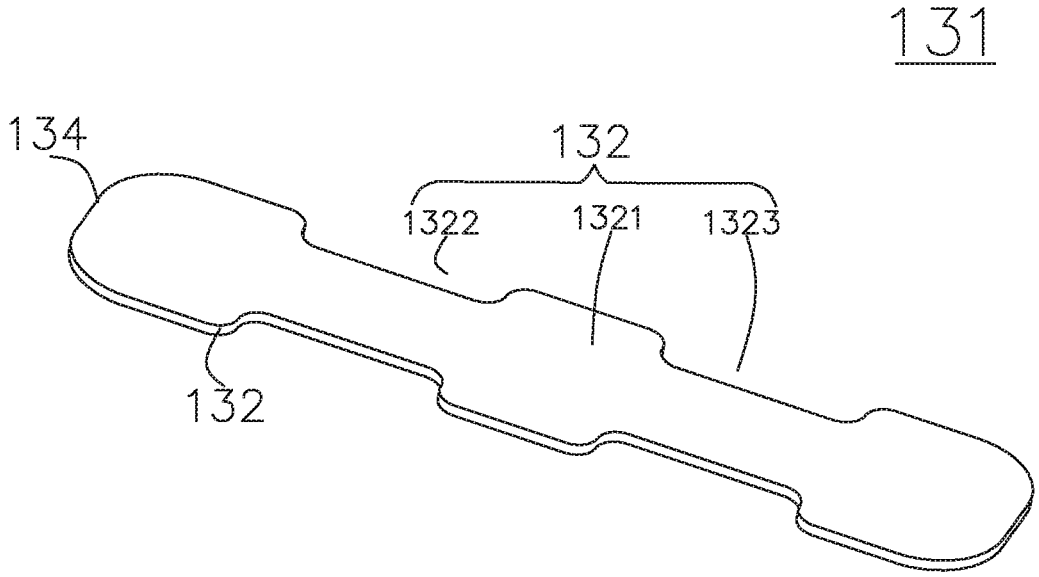
FIG. 4 is a perspective view of the dome in the speaker according to the present disclosure.

In this embodiment, as shown in FIG. 1, the diaphragm 13 is a rectangle, and the dome 131 is a rectangle with rounded corners. The folded ring 133 is an annular hollow structure, and the dome 131 is combined into a hollow portion of the folded ring 133. Matching with a shape of the diaphragm 13, the dome 131 generally has a rectangular structure, taking a direction along a long edge of the diaphragm 13 as a length side and a direction along a short edge of the diaphragm 13 as a short side. Obviously, referring to FIG. 2, the dome 131 in this embodiment includes first side edges 132 arranged oppositely and second side edges 134 connected with the first side edges 132 and arranged oppositely. Corners of the dome, for example, are chamfered structures. It should be noted that the folded ring 133 and the dome 131 may alternatively be an integrated structure. Further, as shown in FIG. 3 and FIG. 4, the dome 131 has a large aspect ratio. In order to avoid strength reduction and split vibration caused by forming a large-sized opening on a long edge of the dome 131 in existing technologies, the following improvements will be made in the present disclosure: the dome 131 includes two or more opening portions disposed separately along the first side edge 132 or the second side edge 134, and an extended portion is arranged between two adjacent opening portions. In this embodiment, the dome 131 includes two first side edges 132 on the upper side and lower side in FIG. 2 and two second side edges 134 on the left side and right side in FIG. 2. A length of the first side edge 132 is greater than that of the second side edge 134. Each first side edge 132 includes a first opening portion 1322 and a second opening portion 1323 disposed separately from each other, and a first extended portion 1321 is arranged between the first opening portion 1322 and the second opening portion 1323. The first extended portions 1321 on the two first side edges 132 are axisymmetric along an axis parallel to the second side edge.

Preferably, the first opening portion 1322 and the second opening portion 1323 are symmetrically arranged on two sides of the first extended portion 1321. The first opening portion 1322 and the second opening portion 1323 have the same cross-sectional shape and the same cross-sectional area. An opening width D of the first opening portion 1322 and the second opening portion 1323 gradually decreases along an opening depth H. Alternatively, the first opening portion 1322 and the second opening portion 1323 may be different. For example, the opening width D of the first opening portion 1322 is an equal opening width, while the opening width D of the second opening portion 1323 gradually decreases along the opening depth H. Please refer to FIG. 3 and FIG. 4 for details. Since the two first side edges 132 have the same structure, the first side edge 132 on the upper side in FIG. 2 will be taken as an example for description, and the description of the other first side edge 132 is omitted. In other embodiments, the second side edge 134 may also include a third opening portion and a fourth opening portion disposed separately from each other, and a second extended portion arranged between the third opening portion and the fourth opening portion. The second extended portions are axisymmetric along an axis parallel to the first side edge 132. The present disclosure is not limited thereto, and the above is only used for illustration. The present disclosure may alternatively have other embodiments as long as a structural strength of a middle portion of the dome 131 is ensured.

Moreover, the dome 131 may alternatively have other shapes such as elliptical, polygonal, and the like. The folded ring 133 is a hollow annular structure, such as a rectangular ring, a circular ring, an elliptical ring, and the like. The folded ring 133 includes a dome portion 1331 located in the middle, a folded ring portion 1332 surrounding the dome portion 1331, and a fixing portion 1333 surrounding the folded ring portion 1332 and fixed to the basket 11. The dome 131 is fixed to the dome portion 1331, and a projection of the dome 131 along a vibration direction is in a projection range of the dome portion 1331 along the vibration direction.

Therefore, two or more opening portions are disposed separately along the first side edge 132 or the second side edge 134 of the dome 131, and an extended portion is arranged between two adjacent opening portions. The structure above ensures a strength of the middle portion of the dome 131, so that high-frequency characteristic of the product is not affected. In addition, mass of the dome 131 is effectively reduced by setting the opening portions at the two sides, and sensitivity of the product is improved.

Comparing the speaker in the present disclosure with existing technologies, the opening portions are arranged at two sides of the middle portion of the long edge of the dome, so that an influence on the strength of the middle portion of the dome is avoided, and the high-frequency characteristic of the product is not affected. In addition, the mass of the dome is effectively reduced by setting the opening portions, and sensitivity of the product is improved.

It should be noted that those ordinary skills in the art may make various modifications and changes without departing from the inventive concept of the present disclosure, and these modifications and changes shall all fall within the scope of protection of the present disclosure.

What is claimed is:

1. A speaker, comprising a basket, a diaphragm fixed to the basket, and a voice coil located below the diaphragm and used for driving the diaphragm to vibrate and sound, wherein the diaphragm comprises a dome in rectangle shape and a folded ring, and the dome comprises two first side edges arranged oppositely and two second side edges connected with the first side edges and arranged oppositely, the dome comprises two or more opening portions disposed separately along the first side edge or the second side edge, and an extended portion is arranged between two adjacent opening portions;

the opening portions along the first side edge extend from one first side edge towards the other first side edge along a direction perpendicular with a vibration direction of the diaphragm; or the opening portions along the second side edge extend from one second side edge towards the other second edge along the direction perpendicular with the vibration direction of the diaphragm.

2. The speaker according to claim 1, wherein two opening portions are provided, the opening portions comprise a first opening portion and a second opening portion separately from each other, and the extended portion comprises a first extended portion arranged between the first opening portion and the second opening portion.

3. The speaker according to claim 2, wherein the first opening portion and the second opening portion are arranged at the first side edge, and the extended portions are axisymmetric along an axis parallel to the second side edge.

4. The speaker according to claim 2, wherein the first opening portion and the second opening portion are arranged at the second side edge, and the extended portions are axisymmetric along an axis parallel to the first side edge.

5. The speaker according to claim 1, wherein the folded ring comprises a dome portion located in the middle, a folded ring portion surrounding the dome portion, and a fixing portion surrounding the folded ring portion and fixed to the basket, the dome is fixed to the dome portion, and a projection of the dome along a vibration direction is in a projection range of the dome portion along the vibration direction.

6. The speaker according to claim 1, wherein the dome is a rectangle with rounded corners.

* * * * *